United States Patent [19]

Namiki

[11] 4,313,981

[45] Feb. 2, 1982

[54] METHOD OF FORMING A ROLL PROTECTIVE LAYER

[75] Inventor: Ryoichi Namiki, Hino, Japan

[73] Assignee: Ricoh Company, Ltd., Japan

[21] Appl. No.: 180,929

[22] Filed: Aug. 25, 1980

Related U.S. Application Data

[63] Continuation of Ser. No. 46,621, Jun. 8, 1979, abandoned, which is a continuation of Ser. No. 844,060, Oct. 20, 1977, abandoned.

[30] Foreign Application Priority Data

Oct. 27, 1976 [JP] Japan ..... 51/129152

[51] Int. Cl.[3] ..... B05D 1/02

[52] U.S. Cl. ..... 427/409; 29/110; 29/122; 29/130; 427/421; 427/425

[58] Field of Search ..... 29/110, 122, 130, 194; 427/428, 421, 425, 409; 101/148, 345

[56] References Cited

U.S. PATENT DOCUMENTS

| | | | |
|---|---|---|---|
| 710,327 | 9/1902 | Kling | 29/122 |
| 1,576,726 | 3/1926 | Davis | 29/122 X |
| 1,669,942 | 5/1928 | Linder | 29/122 |
| 1,926,312 | 9/1933 | Smith | 29/122 |
| 3,435,500 | 4/1969 | Aser et al. | 29/130 |
| 3,467,009 | 9/1969 | Ross | 29/130 |
| 3,686,731 | 8/1972 | Koori et al. | 29/132 |
| 3,737,963 | 6/1973 | Postulka | 29/130 |
| 3,941,635 | 3/1972 | Tavelle et al. | 29/123 |
| 3,971,115 | 7/1976 | Schneider et al. | 29/132 |
| 3,988,817 | 11/1976 | Thettu | 29/130 |

FOREIGN PATENT DOCUMENTS

| | | | |
|---|---|---|---|
| 636311 | 2/1962 | Canada | 29/132 |

*Primary Examiner*—Shrive P. Beck

*Attorney, Agent, or Firm*—McGlew and Tuttle

[57] ABSTRACT

A method is disclosed of protecting a rubber roller or roll which is supplied with oil during use, by coating its end faces. Unless the coating protects the end face in a satisfactory manner, the oil penetrates into the end face to degrade the rubber roller. In accordance with the invention, the end face is inwardly bevelled or tapered in the axial direction, and a protective layer for the end face is formed simultaneously as a protective layer for the peripheral surface of the roller.

4 Claims, 6 Drawing Figures

METHOD OF FORMING A ROLL PROTECTIVE LAYER

This application is a continuation of application Ser. No. 046,621, filed June 8, 1979, now abandoned, which is a continuation of Ser. No. 844,060 filed Oct. 20, 1977, now abandoned.

BACKGROUND OF THE INVENTION

The invention relates to a method of forming a protective layer for a roller used in an electrophotographic copying machine, in particular, for a roller which is used to prevent an offsetting.

Referring to FIG. 1, a roll or roller includes a core metal 1 having a rubber layer 2, such as formed with silicone rubber, for example, formed thereon. An injection nozzle 3 is disposed adjacent the roll, and is operated to apply a spray of rubber solution, which may be silicone rubber, fluorine-contained rubber or silicone rubber fluoride, for example, thereto while rotating the core metal 1, thus forming a protective layer 4. As will be noted from FIG. 1, the end face 5 of the protective layer 2 remains uncovered by the spray solution during such process, but the solution stays around the lower end thereof to form a bead 6, preventing a uniform diameter from being achieved.

Unless the end face 5 is sealed when the roll is used for anti-offset purposes, oil such as silicone oil, for example, may penetrate in the layer 2 between the core metal 1 and the layer 2 and between the layers 2 and 4 to cause a swelling and resulting in degradation of the layer 2. To overcome this difficulty, a sealing solution may be applied to the end face as shown in FIG. 2. However, the surface tension in the liquid applied causes the sealing surface 7 to rise or become protuberant in the middle portion and to be held low around the opposite ends, preventing a satisfactory seal from being achieved at the boundaries with the core metal 1 and the protective layer 4.

SUMMARY OF THE INVENTION

Therefore it is an object of the invention to provide a method of forming a roll protective layer which avoids above disadvantages.

With the method of the invention, a roll surface layer which is to be protected is provided with an outwardly bevelled or tapered surface in the axial direction, at its opposite end faces. A protective layer covers the roll surface including the end faces. The method of the invention avoids the rising of the protective layer on the end faces and assures the formation of a satisfactory seal through a single application step while facilitating the process and reducing the cost.

DESCRIPTION OF PREFERRED EMBODIMENTS

Figure 1:
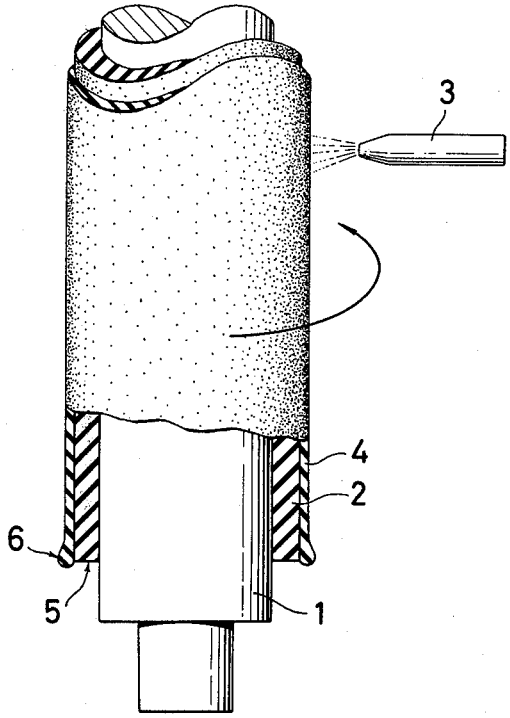
FIG. 1 (PRIOR ART)
FIG. 1 is a schematic view of part of a roll, illustrating a conventional method to form a roll protective layer.
Figure 2:
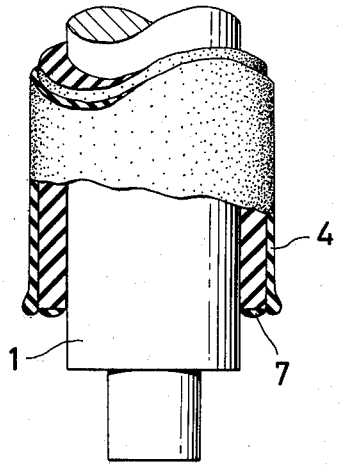
FIG. 2 (PRIOR ART)
FIG. 2 is a similar schematic view illustrating the end face seal formed with the conventional method.
Figure 3:
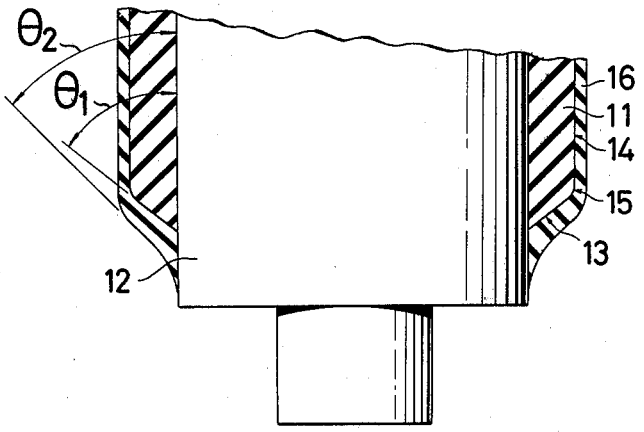
FIGS. 3 to 6 are schematic views of several different rolls obtained with the method of the invention.

Referring to FIG. 3, there is shown one embodiment of the invention. In this Figure, a surface layer or rubber layer with central and end portions 11 to be protected is formed around the periphery of a core metal 12 and includes an end face or surface 13 on the end portion, which, in accordance with the invention, is bevelled or inclined inwardly or tapered in the axial direction of the core metal or rigid cylinder 12 rather than being perpendicular to the axis. The angle $\theta_1$ between the end face 13 and the axis or side wall of cylinder 12 is less than 90°, preferably less than 70°. Preferably, a rounded corner 15 is formed between the end face or surface 13 and the peripheral surface 14 of the central portion. A protective layer 16 is formed on both of these surfaces by supplying a spray of coating solution thereto while rotating the roller in its vertical position. It is to be noted that the spray of coating solution is also directed to the region of the end face 13. Since the end face 13 of the surface layer 11 is inclined, the solution sprayed cannot stay on the end face, but flows to coat it entirely plus to coat a contingent uncovered portion of the cylinder 12. The angle $\theta_2$ formed between the protective layer 16 and the core metal 12 is preferably equal to or less than the angle $\theta_1$.

Figure 4:
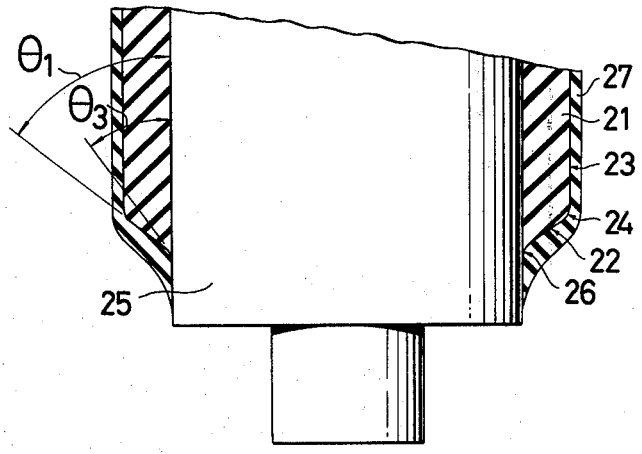

FIG. 4 shows another roll or roller in which a surface layer 21 to be protected has its end face 22 similarly formed to be outwardly bevelled or tapered as viewed in the axial direction. Again a rounded corner 24 is formed between the end face 22 and the peripheral surface 23. In a region 26 of the boundary between the end face 22 and the core metal 25, the end face is angularly shaped or rounded such that an angle $\theta_3$ is formed therebetween which is less than $\theta_1$, more preferably, the region 26 is formed to exhibit a continuous curvature along the core metal 25. A protective layer 27 is formed over the roll and conforms to the end face 22 of the surface layer 21 and hence has a uniform thickness, effectively preventing a shrinkage.

Figure 5:
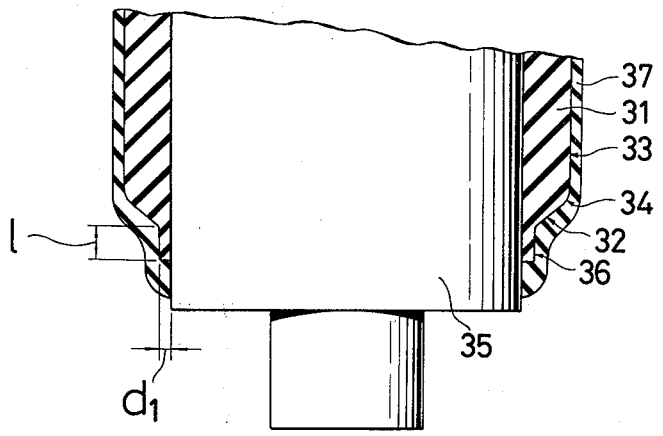

FIG. 5 shows a further roll in which a surface layer 31 to be protected has its end face 32 formed to be bevelled outwardly or tapered in the axial direction of the roll with a rounded corner 34 between the end face 32 and a peripheral surface 33. In a boundary region 36 on a stepped extension between the end face 32 and the core metal 35, the end face continues to extend along the length of the core metal 35 for a distance $\lambda$ and with a constant thickness $d_1$. A protective layer 37 is formed over the roll, and the extension of the surface layer 31 along the core metal 35 for the distance $\lambda$ permits a satisfactory seal to be provided for the surface layer 31.

In practising the invention, it is desirable that the surface layer to be protected has a thickness greater than 100 microns, the protective layer a thickness greater than 10 microns, the rounder corner a radius greater than 1R, and the angle between the end face and the core metal be less than 90°. The thickness $d_1$ of the stepped extension of the surface layer is preferably less than one-half the thickness of the surface layer in the arrangement of FIG. 5.

Figure 6:
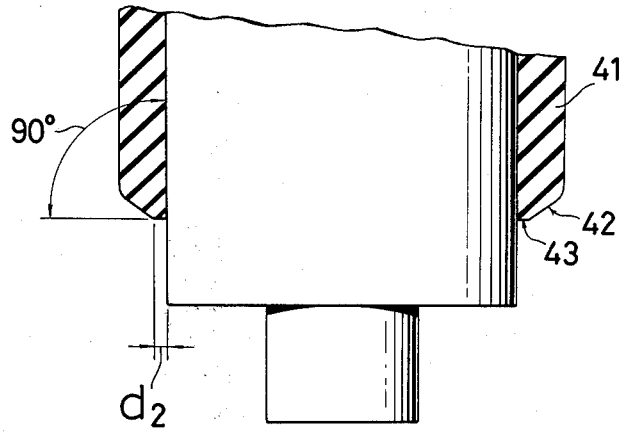

FIG. 6 shows another construction in which a surface layer 41 has an end face which comprises a bevelled portion 42 and a radial portion 43. A surface layer of such construction may also be used if the radial extent $d_2$ of the portion 43 is on the order of one-half the thickness of the entire surface layer 41.

The surface layer to be protected is formed of silicone rubber which is generally in use while the protective layer comprises either fluorine-contained rubber or silicone rubber fluoride.

By way of example, a roll of the type shown in FIG. 3 is constructed using usual silicone rubber for the surface layer 11, silicone rubber fluoride for the protective layer 16, and applying RTV (room temperature vulcanized) silicone rubber as an anti-offset layer. When silicone oil is supplied to the roll surface, no damage of the surface layer 11 occurs as might be caused by swelling as a result of penetration through the end face.

In an alternative arrangement, silicone rubber fluoride is pressed onto the roll of FIG. 3 to serve as the surface layer 11, using the normal procedure, and RTV silicone rubber solution is applied to form an anti-offset layer. The coating of the adhesive layer on the end face is well defined so that no peeling occurred as might be expected from conventional rolls.

What is claimed is:

1. A method of forming a protective layer on an offset preventing roller for use in an electrophotographic copying machine, the roller being of the type having a cylindrical core metal, for protection of the surface of the roller from an offset preventing liquid, comprising the steps of providing, on the cylindrical core metal, a roll surface layer to be protected of a silicone rubber having a uniform diameter intermediate portion of a selected thickness and end portions at each end tapered in the axial direction of the roll from the intermediate portion to the core metal and terminating inwardly of the respective ends of the cylindrical core metal, rotating the cylindrical core roller and surface layer and spraying an oil-resistant fluorine-containing silicone rubber coating over the surface layer while rotating the cylindrical core roller to form a protective layer over the entire surface layer including said end portions and the cylindrical core metal beyond each end of said surface layer, and then applying room temperature vulcanized silicone rubber to the protective layer as an anti-offset layer.

2. A method according to claim 1, wherein the roll surface layer is formed with a bevelled portion and with a step portion of a thickness less than half the thickness of the intermediate portion of the surface layer.

3. A method according to claim 1, wherein each end of the surface layer is provided with a bevelled portion and a portion extending at substantially right angles to the surface of said core metal of a thickness which is less than half the thickness of said surface layer.

4. A method of forming a protective layer on an offset preventing roller for use in an electrophotographic copying machine, the roller being of the type having a cylindrical core metal, for protection of the surface of the roller from an offset preventing liquid, comprising the steps of providing, on the cylindrical core metal, a roll surface layer to be protected of a silicone rubber, said silicone rubber having a uniform thickness and diameter intermediate portion of a selected thickness and end portions at each end, each of said end portions being tapered in the axial direction of the roll from the intermediate portion to the core metal and terminating inwardly of the respective end of the core metal in a boundary portion of constant thickness extending along the cylindrical core metal, rotating the cylindrical core roller, spraying an oil-resistant fluorine-containing silicone coating of silicone over the surface layer while rotating the cylindrical core roller to form a protective layer over the entire surface including the end portions and extending over the core metal beyond each end of said surface layer, and them applying room temperature vulcanized rubber to the protective layer as an anti-offset layer.

* * * * *